US011992088B2

(12) United States Patent
Johnson

(10) Patent No.: US 11,992,088 B2
(45) Date of Patent: May 28, 2024

(54) BREATHABLE ERGONOMIC SHOE INSOLE

(71) Applicant: Chadrian T. Johnson, Cincinnati, OH (US)

(72) Inventor: Chadrian T. Johnson, Cincinnati, OH (US)

( * ) Notice: Subject to any disclaimer, the term of this patent is extended or adjusted under 35 U.S.C. 154(b) by 148 days.

(21) Appl. No.: 17/826,589

(22) Filed: May 27, 2022

(65) Prior Publication Data

US 2022/0378151 A1 Dec. 1, 2022

Related U.S. Application Data

(60) Provisional application No. 63/195,133, filed on May 31, 2021.

(51) Int. Cl.

| | |
|---|---|
| ***A43B 17/00*** | (2006.01) |
| ***A43B 7/06*** | (2006.01) |
| ***A43B 7/08*** | (2022.01) |
| ***A43B 7/1405*** | (2022.01) |
| ***A43B 7/144*** | (2022.01) |

(52) U.S. Cl.

CPC ..... *A43B 17/00* (2013.01); *A43B 7/06* (2013.01); *A43B 7/08* (2013.01); *A43B 7/1405* (2013.01); *A43B 7/144* (2013.01)

(58) Field of Classification Search

CPC ..... A43B 7/1405; A43B 7/06; A43B 7/1425; A43B 7/142; A43B 17/00; A43B 17/08; A43B 7/08; A43B 7/14; A43B 7/144

USPC ..... 36/43

See application file for complete search history.

(56) References Cited

U.S. PATENT DOCUMENTS 1,264,122 A * 4/1918 Paul ..... A43B 7/06 36/3 R
1,730,466 A * 10/1929 Mallott ..... A43B 7/145 36/44
2,200,849 A * 5/1940 Margolin ..... A43B 7/06 36/44
2,221,202 A * 11/1940 Ratcliff ..... A43B 7/1445 36/155
2,224,642 A * 12/1940 Burns ..... A43B 7/1445 36/178
2,246,944 A * 6/1941 Larkin ..... A43B 17/00 36/180
2,432,533 A * 12/1947 Margolin ..... A43B 7/06 36/3 B
2,949,685 A * 8/1960 Burns ..... A43B 7/1415 36/178

(Continued)

OTHER PUBLICATIONS

Amazon, Xinifoot, https://www.amazon.com/Elastic-Absorbing-Breathable-Honeycomb-Replacement/dp/B07YY6HRQC/ref=asc_df_B07YY6HRQC/ Jun. 1, 2019, 10 pages, USA.

(Continued)

*Primary Examiner* — Marie D Bays

(74) *Attorney, Agent, or Firm* — Olav M. Underdal; IDP Patent Services

(57) ABSTRACT

A breathable ergonomic insole for use with a high-heeled shoe includes: an upper layer; an insole body; a plurality of raised support structures, including front, central, and rear support structures; a plurality of perforation assemblies, each comprising a plurality of perforation apertures; front and rear grip patterns; a central grip pattern comprising a plurality of hexagonal indentations, for which a subset is penetrated by a corresponding perforation assembly.

20 Claims, 7 Drawing Sheets

(56) References Cited

U.S. PATENT DOCUMENTS 3,012,342 A * 12/1961 Ramirez ..... A43B 7/06 36/3 B
3,316,663 A * 5/1967 Neu ..... A43B 7/145 36/71
4,078,321 A 3/1978 Famolare, Jr.
4,124,946 A * 11/1978 Tomlin ..... A43B 7/1435 36/43
4,694,590 A * 9/1987 Greenawalt ..... A43B 17/18 36/43
4,776,110 A 10/1988 Shiang
5,809,665 A 9/1998 Suenaga
6,715,221 B1 4/2004 Sasaki
7,617,618 B2 11/2009 Ahlbäumer
7,900,380 B2 3/2011 Rich
8,037,622 B2 10/2011 Lin
8,776,399 B2 7/2014 Tsai
8,813,391 B1 * 8/2014 Khaitan ..... A43B 7/1435 36/28
9,015,961 B2 4/2015 Graziani et al.
2004/0016148 A1 1/2004 Chen
2004/0107600 A1 6/2004 Lin
2004/0194344 A1 10/2004 Tadin
2006/0032082 A1 2/2006 Lin
2006/0265900 A1 11/2006 Lin
2007/0151124 A1 * 7/2007 Chan ..... A43B 7/1445 36/35 R
2008/0250670 A1 10/2008 Lefebvre et al.
2008/0301979 A1 12/2008 Lee
2009/0044424 A1 2/2009 Kohler et al.
2009/0145003 A1 6/2009 Kim
2010/0205831 A1 * 8/2010 Cheskin ..... A43B 1/0009 36/44
2010/0212188 A1 * 8/2010 Granger ..... A43B 17/026 36/44
2010/0251568 A1 * 10/2010 Haruda ..... A43B 17/102 36/43
2013/0318826 A1 * 12/2013 Nathaniel ..... A43B 17/14 36/97
2014/0196319 A1 * 7/2014 Rupprecht ..... A43B 21/26 36/105
2016/0044990 A1 * 2/2016 Georgeson ..... A43B 7/1445 36/43
2016/0366973 A1 12/2016 Wu et al.
2017/0105475 A1 4/2017 Huang
2018/0070670 A1 * 3/2018 Granger ..... A43B 1/0009
2019/0231578 A1 8/2019 Ranganathan et al.
2020/0121029 A1 * 4/2020 Hayashi ..... A43B 1/14
2021/0177088 A1 * 6/2021 Polegato Moretti ..... A43B 7/06
2021/0274885 A1 * 9/2021 Billah ..... A43B 7/144
2021/0392996 A1 * 12/2021 Lee ..... A43B 17/00

OTHER PUBLICATIONS

Amazon, Ailaka, https://www.amazon.com/Ailaka-Absorbing-Increasing-Breathable-Replacement/dp/B07XXXZDC6/ref=asc_df_B07XXXZDC6/?/, Jun. 12, 2017, 13 pages, USA.

* cited by examiner

BREATHABLE ERGONOMIC SHOE INSOLE

CROSS-REFERENCE TO RELATED APPLICATIONS

This U.S. Non-Provisional Application claims the benefit of U.S. Provisional Application No. 63/195,133, filed May 31, 2021; which is hereby incorporated herein by reference in its entirety.

FIELD OF THE INVENTION

The present invention relates generally to the field of shoe insoles, and more particularly to methods and systems for breathable and ergonomic shoe insoles adapted for use with high-heeled shoes.

BACKGROUND OF THE INVENTION

Replacement insoles are often used by consumers to replace original worn insoles and to increase wear comfort.

However, currently available insoles often have inadequate ventilation and do not offer optimal foot support, particularly when used in high-heeled shoes.

As such, considering the foregoing, it may be appreciated that there continues to be a need for novel and improved devices and methods for breathable and ergonomic shoe insoles.

SUMMARY OF THE INVENTION

The foregoing needs are met, to a great extent, by the present invention, wherein in aspects of this invention, enhancements are provided to the existing model of breathable and ergonomic shoe insoles.

In an aspect, an insole system can include:

a) a left insole; and b) a right insole;

wherein each insole of the left and right insoles is adapted for use with high-heeled footwear.

In a related aspect, an insole can include:

a) an insole body; and b) a plurality of raised support structures, which can include:

i. a front support structure, which is mounted on a front portion of a top surface of the insole body;

ii. a central support structure, which is mounted on an inner central portion of the top surface of the insole body; and iii. a rear support structure, which is mounted on a rear portion of the top surface of the insole body.

In another related aspect, the insole body can further include a plurality of perforation assemblies, wherein each perforation assembly in the plurality of perforation assemblies can include:

a) a plurality of perforation apertures, which each penetrate through the insole body.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. In addition, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1A:
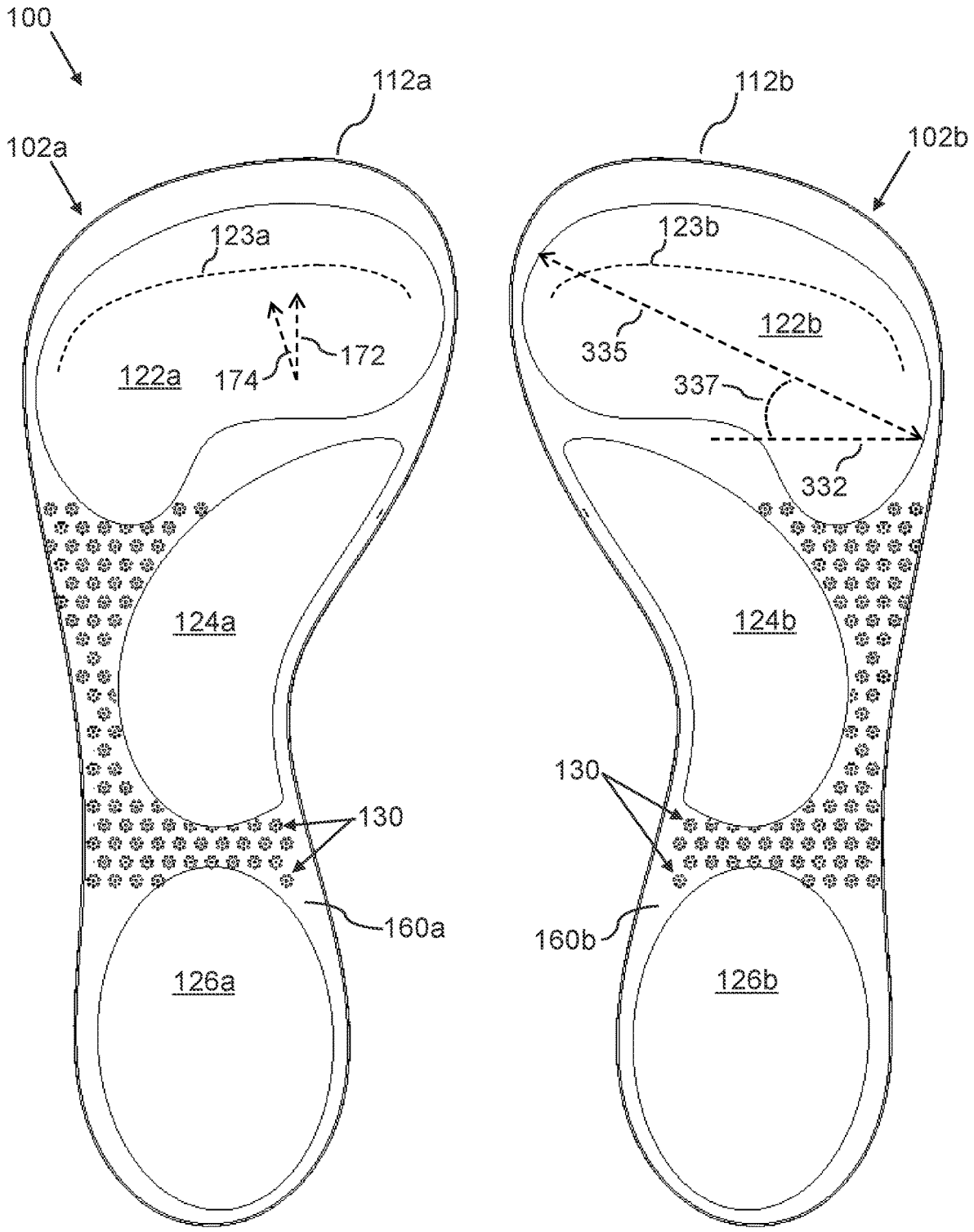
FIG. 1A is a top view of an insole system, according to an embodiment of the invention.

Before describing the invention in detail, it should be observed that the present invention resides primarily in a novel and non-obvious combination of elements and process steps. So as not to obscure the disclosure with details that will readily be apparent to those skilled in the art, certain conventional elements and steps have been presented with lesser detail, while the drawings and specification describe in greater detail other elements and steps pertinent to understanding the invention.

The following embodiments are not intended to define limits as to the structure or method of the invention, but only to provide exemplary constructions. The embodiments are permissive rather than mandatory and illustrative rather than exhaustive.

In the following, we describe the structure of an embodiment of an insole system 100 with reference to FIG. 1A, in such manner that like reference numerals refer to like components throughout; a convention that we shall employ for the remainder of this specification.

In an embodiment, as shown in FIG. 1A an insole system 100 can include:

a) a left insole 102*a*; and b) a right insole 102*b;* wherein each insole 102*a*, 102*b* of the left and right insoles 102*a*, 102*b* is adapted for use with high-heeled footwear.

In an embodiment, as shown in FIGS. 1A— 1E, an insole 102*a*, 102*b* can include:

a) an insole body 112*a*, 112*b*; and b) a plurality of raised support structures 122*a*, 122*b*, 124*a*, 124*b*, 126*a*, 126*b*, which can include:

i. a front support structure 122*a*, 122*b*, which is mounted on a front portion of a top surface of the insole body 112*a*, 112*b*, such that the front support structure 122*a*, 122*b* provides Metatarsalgia support;

wherein the front support structure 122*a*, 122*b* can be raised up to 4 mm or in a range up to 3-5 mm above the top surface of the insole body 112*a*, 112*b;* ii. a central support structure 124*a*, 124*b*, which is mounted on an inner central portion of the top surface of the insole body 112*a*, 112*b*, wherein the central support structure 124*a*, 124*b* can be elongated and curve along on inner side of the top surface of the insole body 112*a*, 112*b*, such that the central support structure 124*a*, 124*b* provides medial arch support for a foot positioned on the insole;

wherein the central support structure can be raised up to 3 mm or in a range up to 2-4 mm above the top surface of the insole body 112*a*, 112*b;* iii. a rear support structure 126*a*, 126*b*, which is mounted on a rear portion of the top surface of the insole body 112, 114, such that the rear support structure 126*a*, 126*b* provides heel support for a foot positioned on the insole;

wherein the rear support structure 126*a*, 126*b* can be raised up to 3 mm or in a range up to 2-4 mm above the top surface of the insole body 112*a*, 112*b;* wherein the front support structure 122*a*, 122*b* can be raised 1 mm or in a range of 0.5-2 mm higher than each of the central support structure 124*a*, 124*b* and the rear support structure 126*a*, 126*b*, thereby providing increased support particularly when the insole is used with high-heeled shoes.

Figure 1B:
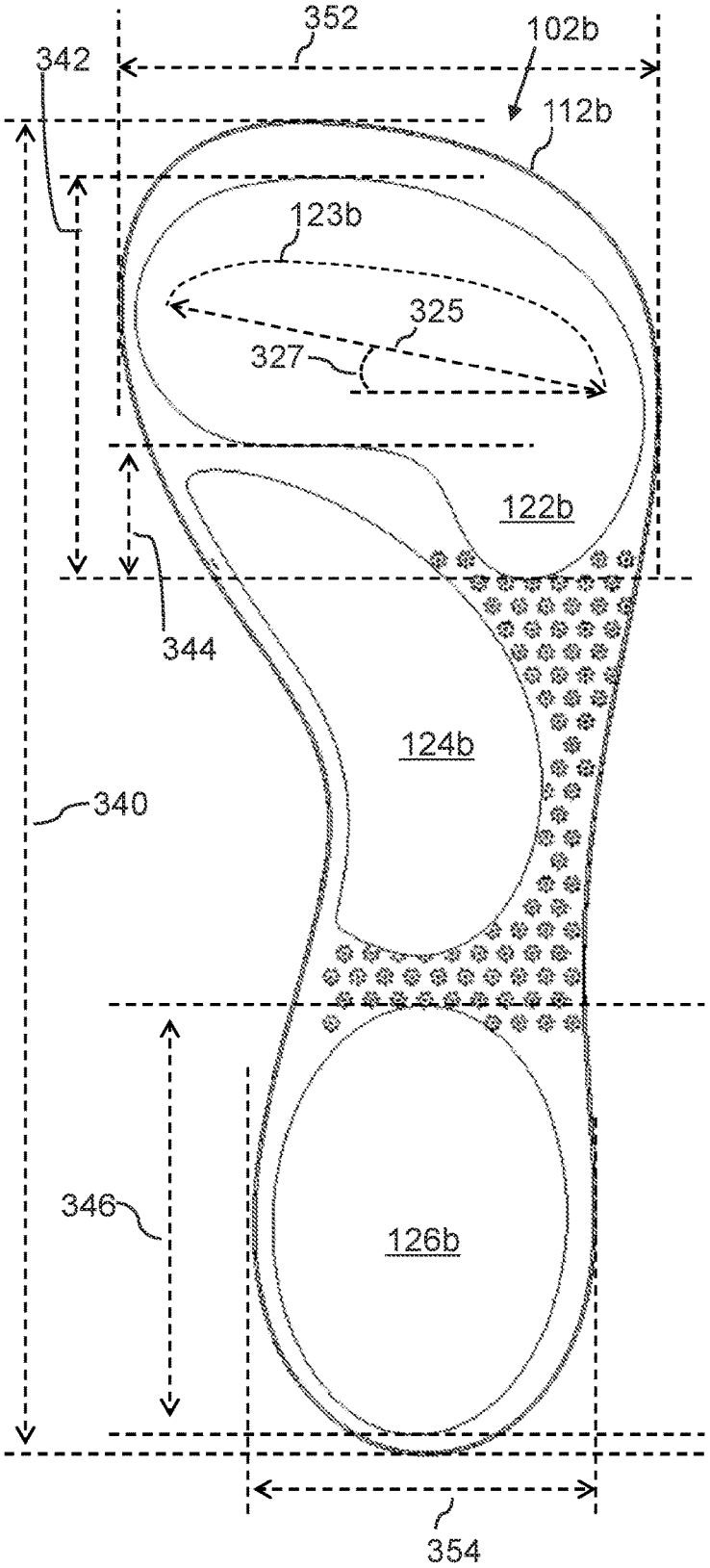
FIG. 1B is a top view of an insole, according to an embodiment of the invention.
Figure 1C:
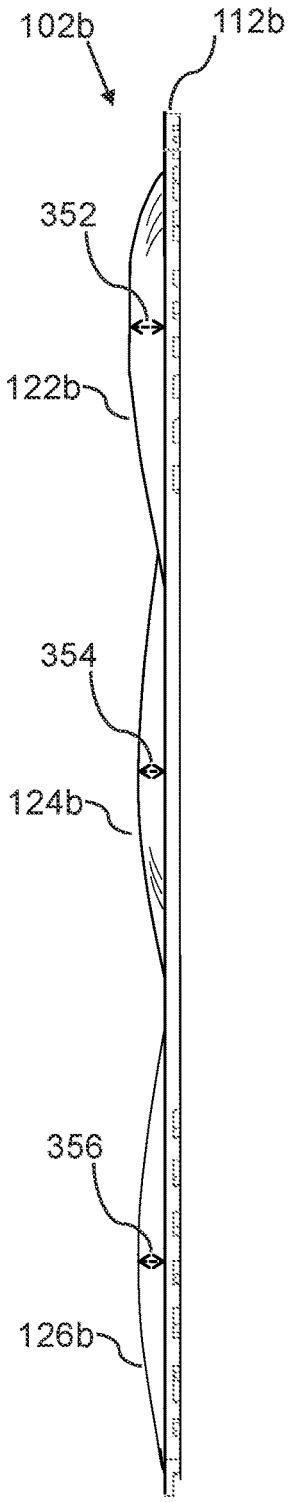
FIG. 1C is a side view of an insole, according to an embodiment of the invention.
Figure 1D:
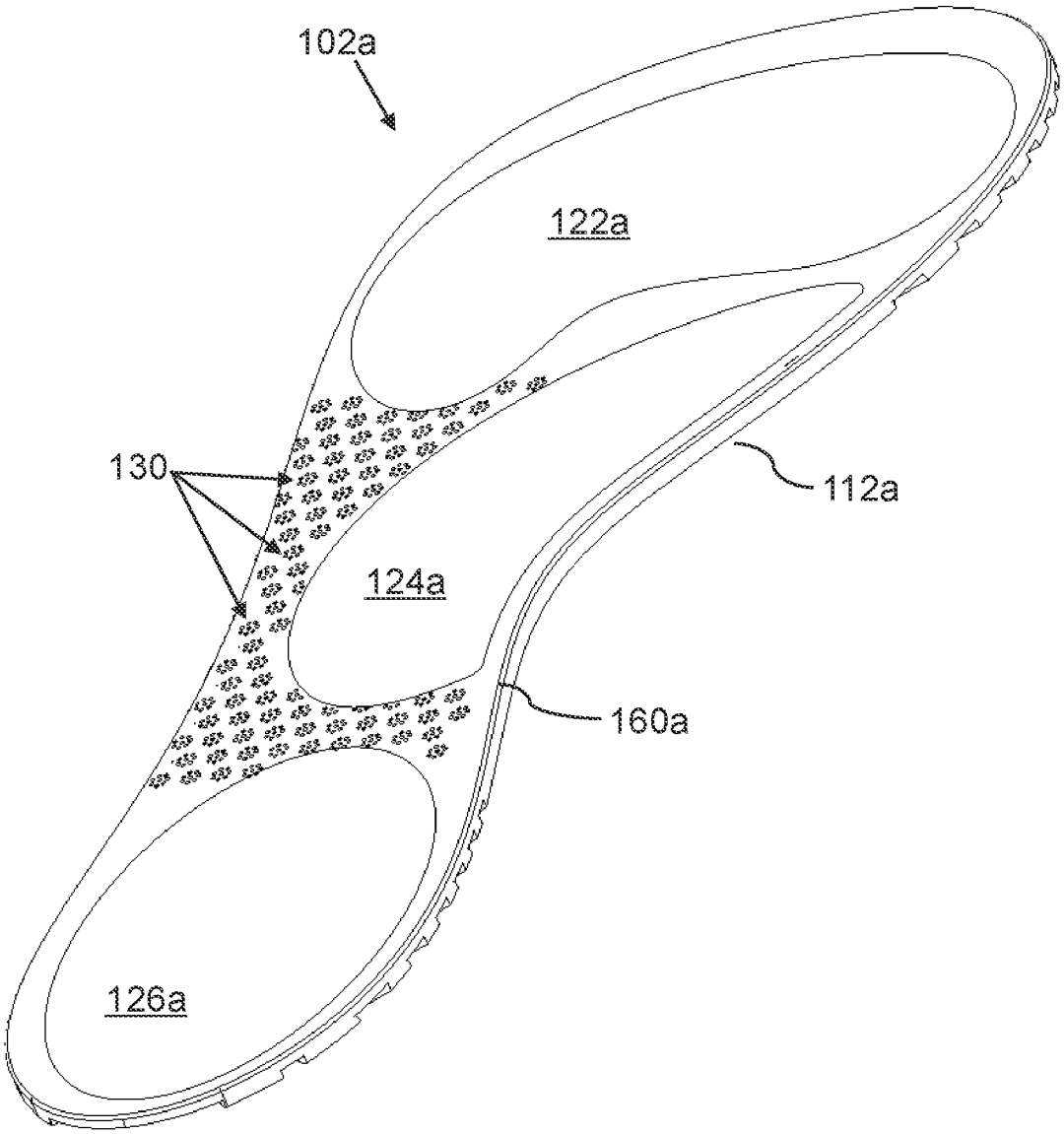
FIG. 1D is a top rear perspective view of an insole, according to an embodiment of the invention.
Figure 1E:
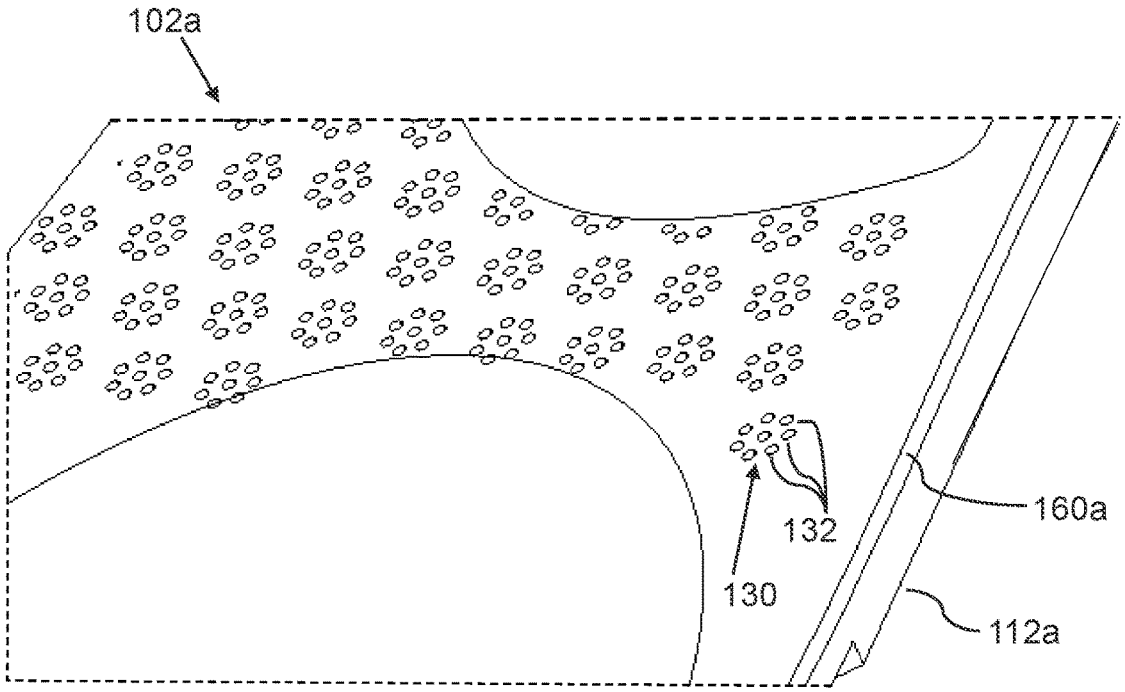
FIG. 1E is a top rear perspective view of a portion of an insole, according to an embodiment of the invention.
Figure 1F:
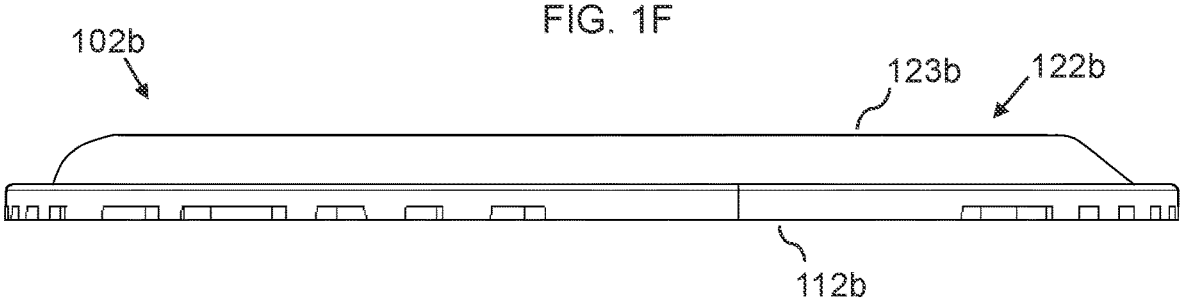
FIG. 1F is a front view of an insole, according to an embodiment of the invention.
Figure 1G:
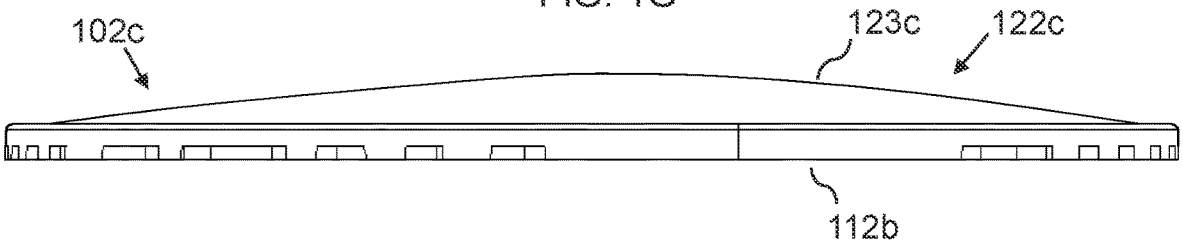
FIG. 1G is a front view of an insole, according to an embodiment of the invention.

In a related embodiment, as shown in FIGS. 1A and 1B, the front support structure 122*a*, 122*b* can further include:

a) a highest point line 123*a*, 123*b*, which is a lateral contour line of a constant maximal height of the front support structure 122*a*, 122*b*, wherein the highest point line 123*a*, 123*b* is rearward concave, such that the highest point line 123*a*, 123*b* is configured to provide forward pressure 172 support for a ball of a sole of a foot positioned on the insole 102*a*, 102*b*. The highest point line 123*a*, 123*b*, 123*c* is thus a lateral ridge of the front support structure 122*a*, 122*b*, 122*c* of the insole 102*a*, 102*b*, 102*c*, which can have constant maximal height, as shown in FIG. 1F, or a variable curved height up to a maximum height, as shown in FIG. 1G.

In a further related embodiment, as shown in FIG. 1B, a maximal section line 325 (from a first end to a second end) of the highest point line 123*a*, 123*b* can be configured with an outward angle 327 of at least 5 degrees, such that the highest point line 123*a*, 123*b* is configured to provide forward outward pressure 174 support for a ball of a sole of a foot positioned on the insole 102*a*, 102*b*. Thereby the forward outward pressure 174 support in combination with the relatively higher front support structure 122*a*, 122*b* provides further increased support, particularly when the insole is used with high-heeled shoes.

In another related embodiment, the insole body 112*a*, 112*b* can further include a plurality of perforation assemblies 130, which are positioned to an outer side of the central support structure 124*a*, 124*b*, below the front support structure 122*a*, 122*b*, and below the central support structure 124*a*, 124*b*, between the central support structure 124*a*, 124*b* and the rear support structure 126*a*, 126*b*, such that the perforation assemblies 130 are not covered by a support structure 122*a*, 122*b*, 124*a*, 124*b*, 126*a*, 126*b*, wherein each perforation assembly 130 in the plurality of perforation assemblies 130 can include:

a) at least one or a plurality of perforation apertures 132, which each penetrates through the insole body 112*a*, 112*b* from a top surface of the insole body 112*a*, 112*b* to a bottom surface of the insole body 112*a*, 112*b;* wherein the perforation apertures 132 can be equidistantly and uniformly positioned in a circle or polygon pattern, such as a hexagonal pattern, as shown in FIGS. 2A, 2B, 2C and 2D, wherein the plurality of perforation apertures 132 can be 8 perforation apertures 132 arranged in a hexagonal pattern, whereby the perforation apertures 132 provide improved ventilation of a sole of a foot resting on the insole.

Figure 2A:
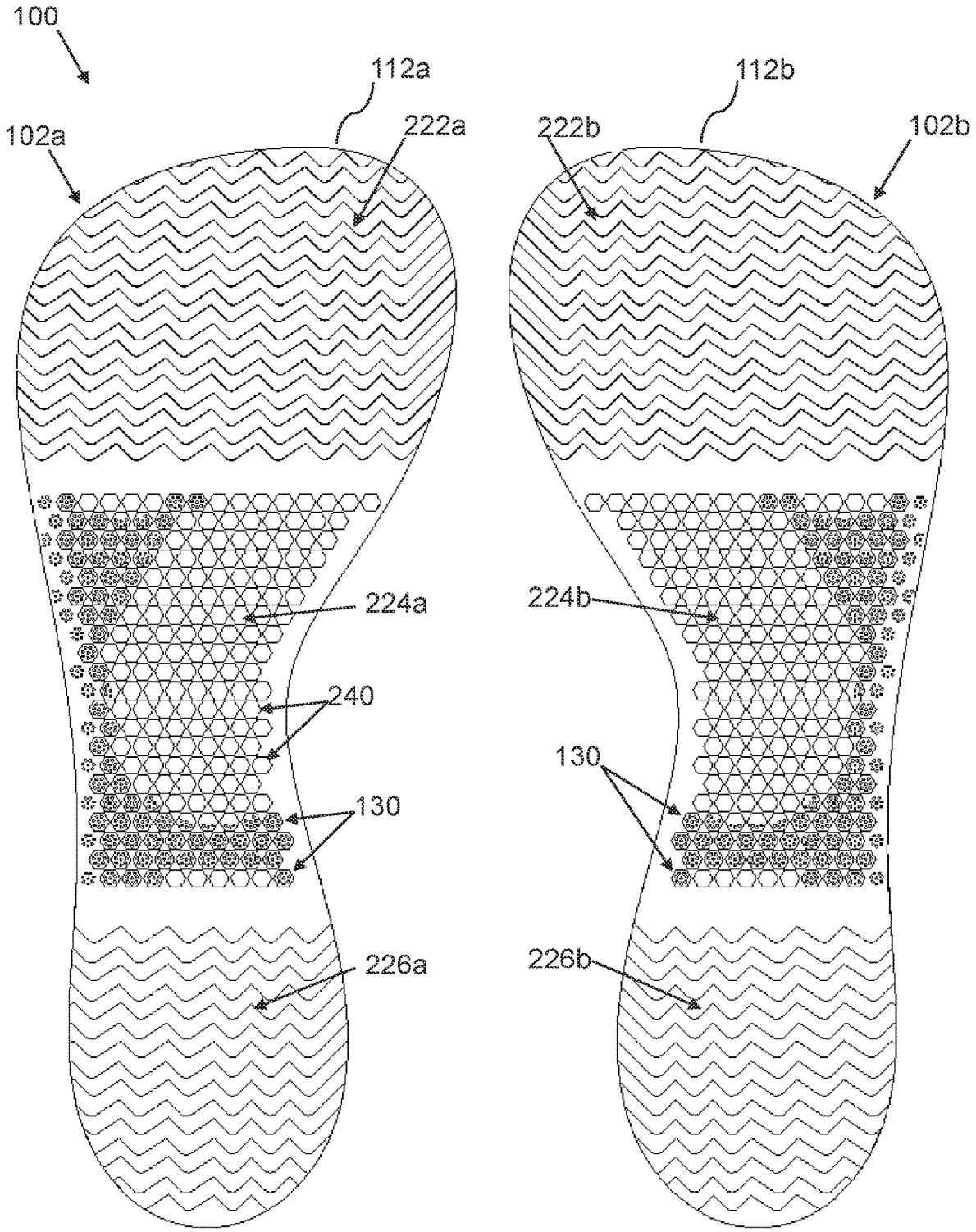
FIG. 2A is a bottom view of an insole system, according to an embodiment of the invention.
Figure 2B:
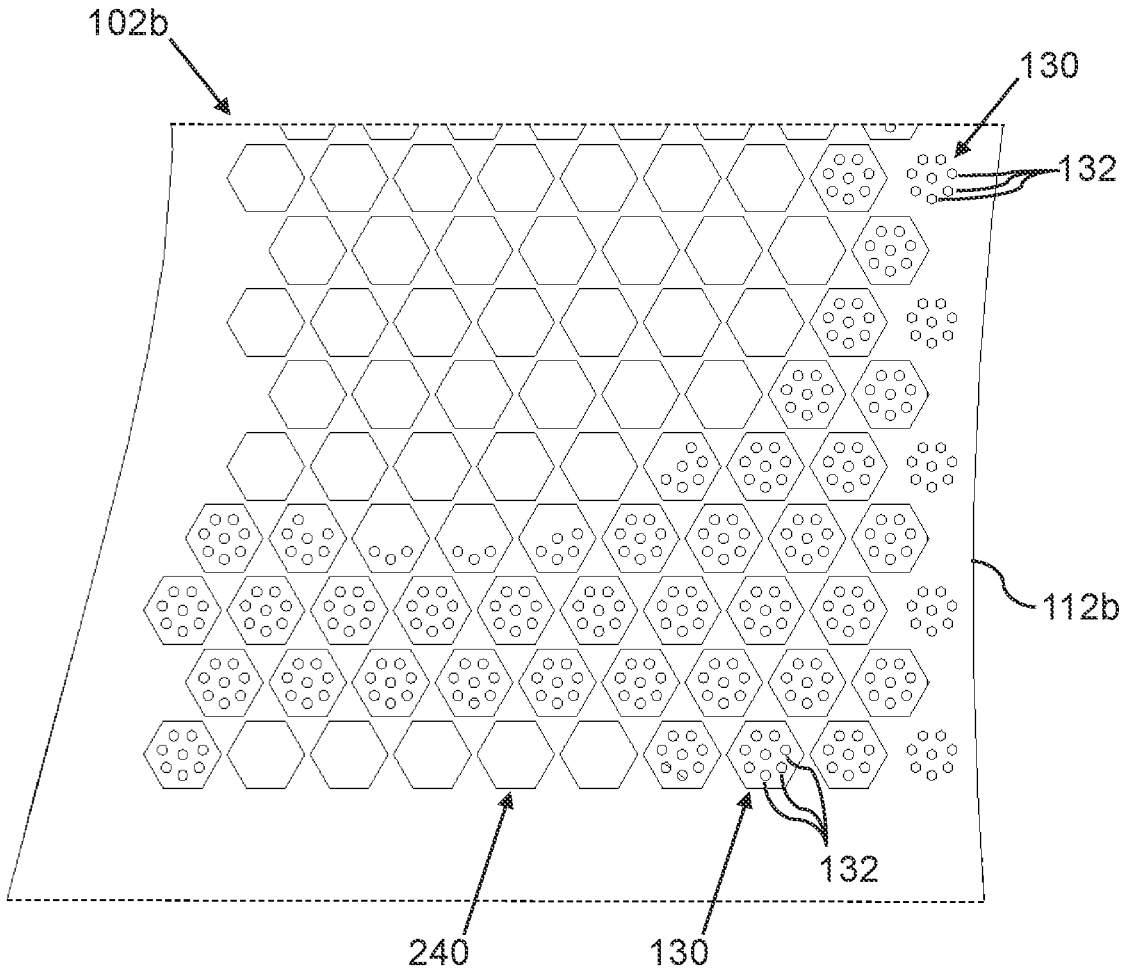
FIG. 2B is a bottom view of a portion of an insole, according to an embodiment of the invention.
Figure 2C:
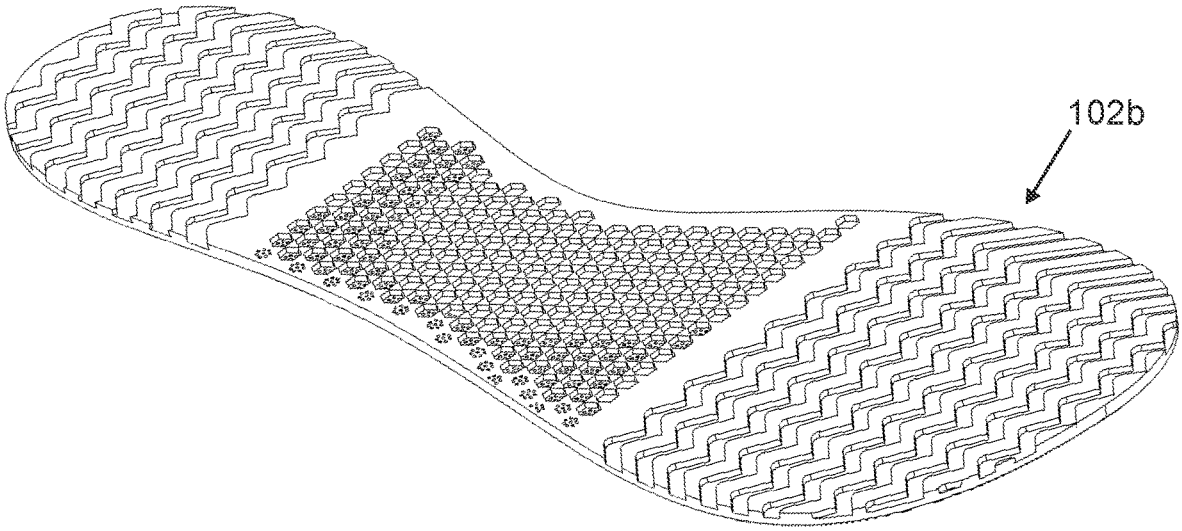
FIG. 2C is a bottom front perspective view of an insole, according to an embodiment of the invention.
Figure 2D:
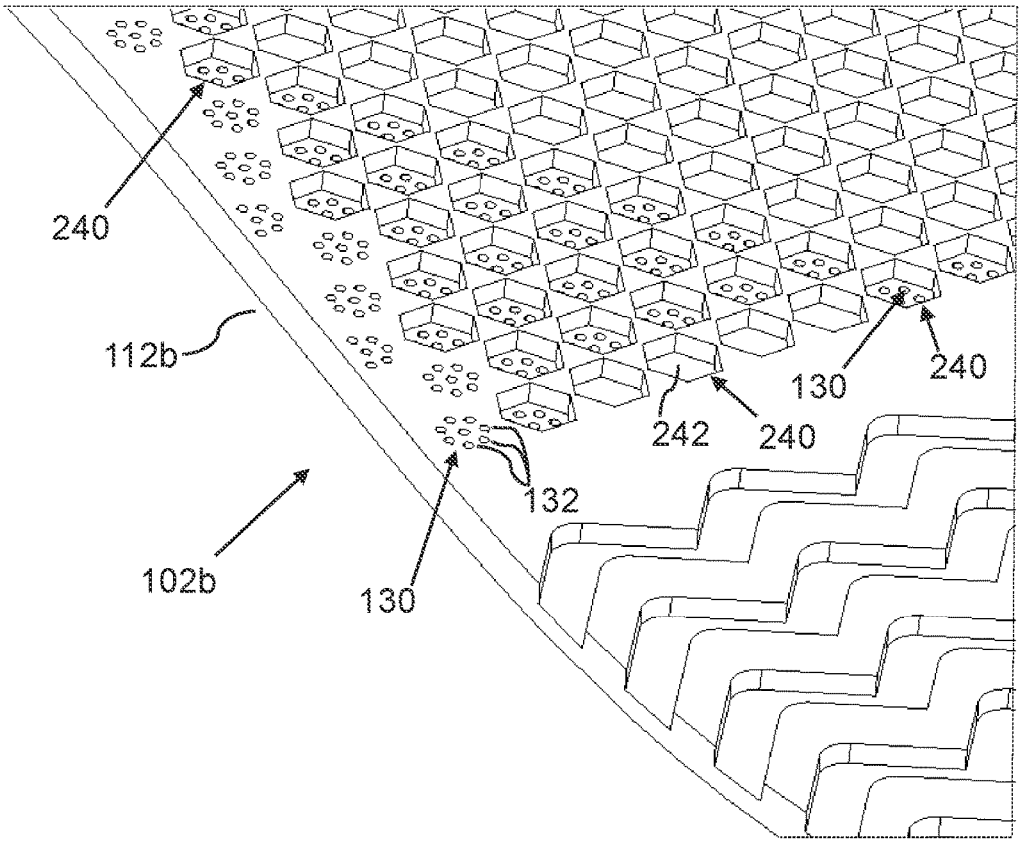
FIG. 2D is a bottom front perspective view of a portion of an insole, according to an embodiment of the invention.

In a related embodiment, as shown in FIGS. 2A, 2B, and 2C a bottom of the insole body 112*a*, 112*b* can further include:

a) a front grip pattern 222*a*, 222*b*, which is positioned on a front portion of the bottom of the insole body 112*a*, 112*b;* b) a central grip pattern 224*a*, 224*b*, which is positioned on a central portion of the bottom of the insole body 112*a*, 112*b*; and c) a rear grip pattern 226*a*, 226*b*, which is positioned on a rear portion of the bottom of the insole body 112*a*, 112*b*.

In a related embodiment, as shown in FIGS. 2A and 2B, the front grip pattern 222*a*, 222*b* and the rear grip pattern 226*a*, 226*b* can be configured with an anti-slip pattern, such as a lateral zig-zag pattern.

In a related embodiment, the central grip pattern 224*a*, 224*b* can include:

a) a plurality of indentations 240, which can be polygonal, wherein each indentation 240 can be configured as a hexagonal indentation 240 with a flat bottom surface 242;

wherein the flat bottom surface of a subset of the polygonal indentations 240 is penetrated by a corresponding plurality of perforation apertures 132 of a corresponding perforation assembly 130 in the plurality of perforation assemblies 130. Whereby the hexagonal indentations allow an optimal grip while allowing space for the perforation apertures 132 to provide improved ventilation of a sole of a foot resting on the insole. The perforations can be made with a conventional industrial needle capable of producing perforations less than 0.5 mm.

In a related embodiment, as shown in FIG. 1B, an insole 102*a*, 102*b* can be configured with dimensions wherein:

a) A length 340 of the insole 102*a*, 102*b* can be 20 cm or in a range of 16-24 cm, or more;

b) a front width 352 of the insole 102*a*, 102*b* can be 5.5 cm or in a range of 3-10 cm, or more; and c) a rear width 354 of the insole 102*a*, 102*b* can be 3.5 cm or in a range of 2-6 cm, or more.

In a related embodiment, as shown in FIGS. 1A and 1B, the front support structure 122*a*, 122*b* can be substantially kidney-shaped, i.e. having the general shape of an elongated oval, which is indented at a rear side, wherein the elongated oval can be oriented with an outward angle 337 (between a longitudinal centerline 335 of the elongated oval and a lateral line 332 of the insole 102*a*, 102*b*) of at least 5 degrees, thereby providing improved forward outward pressure 174 support for a ball of a sole of a foot positioned on the insole 102*a*, 102*b*, particularly when the insole is used with high-heeled shoes; and wherein:

a) a lateral distance 342 between a front edge of an inner portion of the front support structure 122*a*, 122*b* and a rear edge of an outer portion of the front support structure 122*a*, 122*b* can be substantially 7 cm, or in a range of 5-9 cm; and b) a lateral distance 344 between a rear edge of an inner portion of the front support structure 122*a*, 122*b* and a rear edge of an outer portion of the front support structure 122*a*, 122*b* can be substantially 2 cm, or in a range of 1-4 cm.

In a related embodiment, the rear support structure 126*a*, 126*b* can be shaped as a longitudinally oriented elongated oval with a length 346 of substantially 6 cm or in a range of 4-8 cm, or more.

In a related embodiment, the raised support structures 122*a*, 122*b*, 124*a*, 124*b*, 126*a*, 126*b* can be made from a natural or synthetic rubber material, which can include medical grade silica gel or a gel made of a thermoplastic elastomer, wherein the raised support structures 122*a*, 122*b*, 124*a*, 124*b*, 126*a*, 126*b* can be configured with a hardness of 10-15 A°, as measured in Shore durometer Type A unit of measure.

In an embodiment, the insole 102*a*, 102*b* can be designed to accommodate a plurality of functional goals, including:

a) Uniform pressure distribution;
b) Highly washable;
c) Comfortable;
d) Anti-slip;
e) Low-cost manufacturing;
f) Light-weight;
g) Thin/slim form factor that is flexible/bendable;
h) Breathable, ventilating construction; and
i) Hypoallergenic.

In an embodiment, the insole 102*a*, 102*b* can further include:

a) an upper layer 160*a*, 160*b*, which can be positioned on top of the insole body 112*a*, 112*b*, wherein the upper layer can be made from a textile material, such that the perforation apertures 132 penetrate through the upper layer;

wherein the textile material can be a recyclable worsted velvet wool or LYCRA COOLMAX™, a polyester based woven fabric with low GSM (<100). These fiber types are breathable and do not accumulate sweat, and hence are suitable for all seasons. The Top textile layer 160*a*, 160*b* and the insole body 112*a*, 112*b* can be bonded together using thermal bonding technique with or without use of a resin.

In related embodiments, the gel used for the raised support structures 122*a*, 122*b*, 124*a*, 124*b*, 126*a*, 126*b* can be solvent free and can include a resin and a curing agent. The gel can for example be a soft silicon rubber, which is platinum-cured with platinum chromite and has isotropic elasticity properties, such that applied load/pressure is evenly distributed in all directions. The gel can be configured with physical properties wherein:

a) The hardness is 10-15 A°;
b) Tensile strength (kgf/cm2)=25-30;
c) Tear strength (KN/m)≥10; and
d) Elongation (%)≥400.

In other related embodiments, the insole body 112*a*, 112*b* with anti-slip patterns can be made from medical grade silicone with anti-slip ripple. The ripple pattern (node and crest pattern) offers a high coefficient of friction, which is enhanced by the use of silicone.

In other related embodiments, the central grip pattern 224*a*, 224*b* is configured to provide a high degree of breathability. The perforations 132 allow heat and sweat to through and keep the foot at room temperature/ambient temperature. The textile layer 160*a*, 160*b* with honey comb perforated structure enhance the thermo-physiological comfort.

Here has thus been described a multitude of embodiments of the insole system 100, the insole 102*a*, 102*b*, and methods related thereto, which can be employed in numerous modes of usage.

The many features and advantages of the invention are apparent from the detailed specification, and thus, it is intended by the appended claims to cover all such features and advantages of the invention, which fall within the true spirit and scope of the invention.

Many such alternative configurations are readily apparent and should be considered fully included in this specification and the claims appended hereto. Accordingly, since numerous modifications and variations will readily occur to those skilled in the art, the invention is not limited to the exact construction and operation illustrated and described, and thus, all suitable modifications and equivalents may be resorted to, falling within the scope of the invention.

What is claimed is:

1. An insole, comprising:

a) an insole body; and b) a plurality of raised support structures, comprising:

a front support structure, which is mounted on a front portion of a top surface of the insole body; and a central support structure, which is mounted on an inner central portion of the top surface of the insole body;

wherein the front support structure is raised up to 3-5 mm above the top surface of the insole body; wherein the central support structure is raised up to 2-4 mm above the top surface of the insole body; and wherein a maximal height of the front support structure is 0.5-2 mm higher than a maximal height of the central support structure.

2. The insole of claim 1, wherein the front support structure comprises:

a highest point line, which is a lateral contour line of a constant maximal height of the front support structure, wherein the highest point line is rearward concave.

3. The insole of claim 2, wherein a maximal section line of the highest point line is configured with an outward angle of at least 5 degrees, whereby the highest point line is configured to provide forward outward pressure support.

4. The insole of claim 1, wherein the front support structure is kidney-shaped with a shape of an elongated oval, which is indented at a rear side;

wherein the elongated oval is oriented with an outward angle of at least 5 degrees between a longitudinal centerline of the elongated oval and a lateral line of the insole.

5. The insole of claim 1, wherein the plurality of raised support structures further comprises:

a rear support structure, which is mounted on a rear portion of the top surface of the insole body.

6. The insole of claim 5, wherein the rear support structure is raised up to 2-4 mm above the top surface of the insole body and wherein the front support structure is 0.5-2 mm higher than each of the central support structure and the rear support structure.

7. The insole of claim 1, wherein the insole body further comprises:

a plurality of perforation assemblies, which are positioned to an outer side of the central support structure, and posterior to the central support structure, such that the perforation assemblies are not covered by a support structure; wherein each perforation assembly in the plurality of perforation assemblies comprises at least one perforation aperture, which penetrates through the insole body from a top surface of the insole body to a bottom surface of the insole body.

8. The insole of claim 7, wherein each perforation assembly in the plurality of perforation assemblies comprises:

a plurality of perforation apertures, which each penetrate through the insole body from a top surface of the insole body to a bottom surface of the insole body.

9. The insole of claim 8, wherein the perforation apertures are equidistantly positioned.

10. The insole of claim 8, wherein a bottom of the insole body further comprises:

a central grip pattern, which is positioned on a central portion of a bottom of the insole body;

wherein the central grip pattern comprises:

a plurality of indentations, which each comprises a bottom surface;

wherein the bottom surface of a subset of the indentations is penetrated by a corresponding plurality of perforation apertures of a corresponding perforation assembly in the plurality of perforation assemblies.

11. The insole of claim 10, wherein each indentation in the plurality of indentations is configured as a hexagonal indentation.

12. The insole of claim 10, wherein the bottom of the insole body further comprises:

a) a front grip pattern, which is positioned on a front portion of the bottom of the insole body; and b) a rear grip pattern, which is positioned on a rear portion of the bottom of the insole body.

13. An insole, comprising:

a) an insole body; and b) a plurality of raised support structures, comprising:

a front support structure, which is mounted on a front portion of a top surface of the insole body; and a central support structure, which is mounted on an inner central portion of the top surface of the insole body;

wherein the insole body further comprises:

a plurality of perforation assemblies, which are positioned to an outer side of the central support structure, and posterior to the central support structure, such that the perforation assemblies are not covered by a support structure;

wherein each perforation assembly in the plurality of perforation assemblies comprises:

a plurality of perforation apertures, which each penetrate through the insole body from a top surface of the insole body to a bottom surface of the insole body;

wherein a bottom of the insole body further comprises:

a central grip pattern, which is positioned on a central portion of a bottom of the insole body;

wherein the central grip pattern comprises:

a plurality of indentations, which each comprises a bottom surface;

wherein the bottom surface of a subset of the indentations is penetrated by a corresponding plurality of perforation apertures of a corresponding perforation assembly in the plurality of perforation assemblies.

14. The insole of claim 13, wherein the front support structure is kidney-shaped with a shape of an elongated oval, which is indented at a rear side;

wherein the elongated oval is oriented with an outward angle of at least 5 degrees between a longitudinal centerline of the elongated oval and a lateral line of the insole.

15. The insole of claim 13, wherein the front support structure comprises:

a highest point line, which is a lateral contour line of a constant maximal height of the front support structure, wherein the highest point line is rearward concave.

16. The insole of claim 15, wherein a maximal section line of the highest point line is configured with an outward angle of at least 5 degrees, whereby the highest point line is configured to provide forward outward pressure support.

17. The insole of claim 13, wherein the insole body further comprises:

a plurality of perforation assemblies, which are positioned below the front support structure, such that the perforation assemblies are not covered by a support structure;

wherein each perforation assembly in the plurality of perforation assemblies comprises at least one perforation aperture, which penetrates through the insole body from a top surface of the insole body to a bottom surface of the insole body.

18. The insole of claim 17, wherein each perforation assembly in the plurality of perforation assemblies comprises:

a plurality of perforation apertures, which each penetrate through the insole body from a top surface of the insole body to a bottom surface of the insole body.

19. An insole, comprising:

an insole body; and at least one raised support structure, comprising:

a front support structure, which is mounted on a front portion of a top surface of the insole body; and wherein the insole body further comprises:

a plurality of perforation assemblies, which are positioned below the front support structure, such that the perforation assemblies are not covered by a support structure;

wherein each perforation assembly in the plurality of perforation assemblies comprises a plurality of perforation apertures, which each penetrate through the insole body from a top surface of the insole body to a bottom surface of the insole body;

wherein a bottom of the insole body further comprises:

a central grip pattern, which is positioned on a central portion of a bottom of the insole body;

wherein the central grip pattern comprises:

a plurality of indentations, which each comprises a bottom surface;

wherein the bottom surface of a subset of the indentations is penetrated by a corresponding plurality of perforation apertures of a corresponding perforation assembly in the plurality of perforation assemblies.

20. The insole of claim 19, wherein each indentation in the plurality of indentations is configured as a hexagonal indentation.

* * * * *